US005793877A

United States Patent [19]

Tagg

[11] Patent Number: 5,793,877

[45] Date of Patent: Aug. 11, 1998

[54] THROUGH-WINDOW SPEAKER/ MICROPHONE

[75] Inventor: James Peter Tagg, Cambridge, Mass.

[73] Assignee: Moonstone Technology Limited, Kent, England

[21] Appl. No.: 445,334

[22] Filed: May 19, 1995

[51] Int. Cl.[6] ..... H04R 25/00

[52] U.S. Cl. ..... 381/156; 181/150

[58] Field of Search ..... 381/152, 204, 381/188, 205, 194; 181/180

[56] References Cited

U.S. PATENT DOCUMENTS

| | | | |
|---|---|---|---|
| 3,609,253 | 9/1971 | Ashworth | 381/152 |
| 3,728,497 | 4/1973 | Komatsu | 381/152 |
| 3,848,090 | 11/1974 | Walker | 381/152 |
| 3,925,627 | 12/1975 | Ashworth | 381/152 |
| 4,926,486 | 5/1990 | Barsumian | 381/197 |
| 5,022,084 | 6/1991 | Shinjo | 381/152 |
| 5,058,173 | 10/1991 | Ashworth | 381/152 |
| 5,400,412 | 3/1995 | King, Sr. et al. | 381/152 |
| 5,706,358 | 1/1998 | Ashworth | 381/152 |

*Primary Examiner*—Curtis A. Kuntz
*Assistant Examiner*—Rexford Barnie
*Attorney, Agent, or Firm*—Brian M. Dingman

[57] ABSTRACT

A system for radiating sound from a movable member, with a speaker which includes a loudspeaker with a longitudinally movable speaker coil, a flat glass plate spaced from the speaker coil, and a rigid mechanical member connected between the speaker coil and the flat plate to transfer longitudinal motion of the speaker coil to the flat plate, to cause movement of the flat plate. There is also a speaker mount for acoustically and mechanically coupling the flat plate to a window to efficiently transfer plate movements to the window for causing the window to directly radiate sound as a result of speaker coil motion.

12 Claims, 6 Drawing Sheets

THROUGH-WINDOW SPEAKER/ MICROPHONE

FIELD OF INVENTION

The present invention relates to a means of transmitting sound into an area outside a shop or kiosk through its window without generating unacceptable levels of noise within the shop or kiosk.

BACKGROUND OF INVENTION

The use of multimedia information systems is growing rapidly. Many people now use a system for sensing a human touch on the outside of a shop window to control an information system. The monitor can be seen through the glass but sound generated by speakers within the shop does not penetrate the glass very well. Approximately 20 dB or greater is lost through the glass, and this makes it impractical to simply turn up the sound level until it can be heard outside. If the sound level were turned up to that point, it would be a considerable nuisance to people within the shop and be wasteful of power.

An obvious solution is to mount speakers outside the shop. There are three main problems with this. The speakers are prone to vandalism and the elements. The placing of speakers outside a shop contravenes planning regulations in some areas. Also, the cost of drilling holes through the shop window surround and installing a speaker outside is high.

SUMMARY OF THE INVENTION

The present invention solves these problems by coupling the sound directly to the shop window. Thus the shop window itself vibrates, carrying sound to the outside world. According to the present invention the coupling is achieved by attaching a speaker coil to a glass plate by way of a sound post. Speaker coil motion causes the glass plate to vibrate. Placing this vibrating plate against the glass of the window couples the sound efficiently to the window using the inherent glass to glass adhesion of two clean glass surfaces. Additionally, the acoustic impedance (stiffness per unit mass) of the two plates of glass are the same so the transmission of sound is nearly 100% efficient.

Making a glass plate work as an efficient speaker requires two methods of sound propagation. For wavelengths substantially smaller than the size of the glass plate of the speaker, bending moments must be introduced in the glass. For wavelengths substantially larger than the size of the glass plate, the reactive mass of the speaker is employed to push the entire glass plate back and forth using its frame as the pivot. At wavelengths around the size of the plate a certain compliance in the construction avoids too strong a peak in the audio response. This compliance may be achieved by employing acrylic tape (about 25 mm wide) to adhere the glass plate to the speaker box. Thus the bond is distributed over a large area, which distributes the pivot point and provides a degree of damping.

An advantage of the invention is that no external construction is required to install the speaker.

Another advantage of the invention is that no modifications are made to the window and the device can be easily installed and removed.

Another advantage of the invention is that a cantilever arrangement is used to produce bending moments in the glass plate which transmit high frequency sound making speech highly intelligible.

Another advantage of the invention is that with appropriate sound deadening material used in the speaker construction substantially less sound is radiated back into the shop than out in the street.

Another advantage of the invention is that the acrylic tape bonds provide compliance and damping in the pivot for the glass plate avoiding too much of a peak in frequency response.

Another advantage of the invention is that as constructed the glass plate is slightly smaller than the overall dimension of the box providing protection for the edge of the glass. Were the glass to extend to the full size of the box, the edges could be prone to damage.

An advantage of the stand arrangement is that the speaker settles under its own weight to the optimum contact position, so that external disturbances and the settling of the stand are automatically compensated for.

An advantage of the wire arrangement for holding the speaker in place is that very little shop floor space is used.

In a preferred embodiment, a dark glass plate is bonded or glued to a plastic frame which is then bonded or glued to a plate into which the speaker is held. The speaker cone is cut away and a wooden sound post is connected between the speaker coil and the glass plate through a hole in the speaker plate. Application of electrical signals to the speaker coil causes movement in the glass plate and equal and opposite movements in the frame and thus the edge of the glass plate. This push-pull action causes the plate to bend, introducing high frequency pressure waves into the glass. These are radiated from the glass as sound pressure waves. Further glass plates (the window) placed in contact with the speaker plate couple sound with an almost 100% transmission efficiency. Thus placing the glass plate up against the inside of the window causes high levels of sound to be propagated on the other side of the window.

Preferably, an efficient speaker stand is employed. A good stand should provide pressure to push the speaker towards the window and keep the glass speaker plate in even contact with the glass. Two such an arrangements are described in the figures which follow.

Preferably, an amplifier is employed which has its output characteristic matched to the characteristics of the speaker.

Preferably, sound absorbing materials are used to reduce the sound emanating from the rear and sides of the speaker box. Some or all of the following techniques can be employed.

1. The box can be filled with sound absorbing wool or tar soaked fibers.

2. Foam-lead-foam sound proofing material can be used to cover the inside of the box, stopping sound within the box from escaping to the outside.

3. Tar based self adhesive material can be attached to the outside of the box to stop sound propagating along the edges of the box and causing the rear of the box to vibrate.

Preferably, sound deadening material can be used to reduce the sound propagated back from the glass. Some or all of the following techniques can be employed.

1. Tar based self adhesive damping plate can be affixed to the inside of the window around the speaker to stop sound propagating along the glass away from the speaker. This keeps the high frequency sound localized in the immediate area of the speaker.

2. A gasket can be placed on the front face of the box around the edge of the glass plate. This helps keep high frequency sound localized in the area of the speaker.

3. A sound absorbent panel or hood can be placed immediately behind the speaker but not in contact with the speaker so as to contain the sound from the rear of the speaker.

Preferably, the primary speaker cone is completely removed, leaving only the secondary suspension membrane. The glass and sound post provide sufficient support for the speaker coil to keep it properly suspended within the gap in the speaker magnet. This reduces the amount of airborne sound in the speaker enclosure and makes damping the sound easier.

Alternatively, most materials can be substituted for materials which have been described above provided the engineer makes use of common sense in their application. The box can be made of wood or metal, the spacers from wood, metal and so on. Care should be taken regarding the audio properties of these substitute materials.

Alternatively, the arrangement can be reversed such that vibrations of the window caused by external sound waves cause the speaker arrangement to vibrate and form a through-glass microphone. In this case the sizes of the assembly can be greatly reduced but the general principle remains the same.

In principle the speaker and its cabinet can be made in many different sizes. The critical dimensions are as follows:

The thickness of the front glass plate should be between 3 mm and 10 mm. Optimally 6 mm.

The speaker coil diameter should be approximately 20 mm–30 mm to allow for a sufficiently strong sound post.

The sound post should be approximately 20–30 mm in diameter but turned down to fit exactly the inside dimension of the speaker coil.

The speaker employed needs to have a reasonable frequency response from 300 Hz–10,000 Hz to allow adequate representation of speech and music. This desired response tends to suggest speaker sizes in the range of 100–200 mm cone diameter. The speaker cabinet is then constructed so as to be large enough to contain the speaker and provide sufficient space behind it to put sound absorbing panels and acoustically absorbent wool.

BRIEF DESCRIPTION OF THE DRAWINGS

Other objects, features and advantages will occur to those skilled in the art from the following description of preferred embodiments and the accompanying drawings, in which.

DESCRIPTION OF THE PREFERRED EMBODIMENTS

Figure 1:
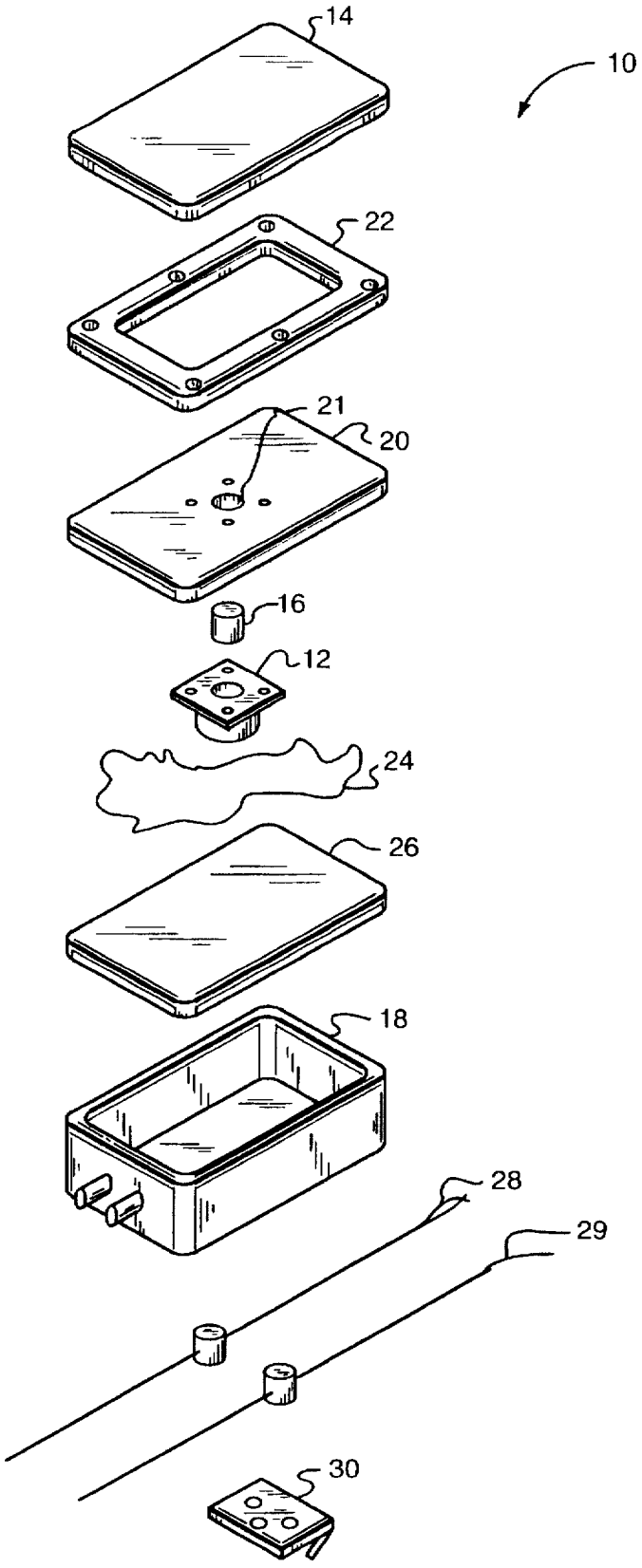
FIG. 1 is an exploded view of one embodiment of a system for radiating sound from a window according to this invention.

The through glass speaker and/or microphone of this invention can be used in conjunction with a multimedia system to provide audio/visual interaction for customers while a shop is shut. A through glass keypad which can sense the touch of a human finger on the outside of the glass, is connected to a computer which in turn is connected to a through glass speaker. Touching a particular button or combination of buttons on the outside of the window causes audio, video or both to be played by the computer. The through glass speaker of this invention allows the user on the outside to hear the audio response through the shop window.

In the application of a through glass multimedia system the speaker can be used to provide tactile feedback for a through glass keypad by playing a sound when the keypad is detected. This sound can be felt by the operator's finger, as well as heard.

In the application of conferencing sound systems the unit can be placed on or below a large conference table, transmitting sound via the fabric of the table. The sound propagates along the table through the material of the table rather than through the air of the conference room. The sound is heard clearly by anyone sitting in close proximity to the table, and sound levels can be reduced to permit general conversation to be heard in the rest of the conference room.

This invention may be accomplished in a system for radiating sound from a movable member such as a window. The invention also features a system for transducing sound through a movable member such as a window. The invention thus accomplishes a through-window speaker and/or microphone. The speaker and microphone can also be accomplished through other surfaces that can transmit vibrations that can be transduced into sound, such as a conference table top.

The system for radiating sound includes a loudspeaker with a longitudinally-movable speaker coil and a flat plate spaced from the speaker coil. For use on a window, such as the window of a shop or kiosk, the flat plate is glass. There is a rigid mechanical member such as a post which is connected between the speaker coil and the flat plate to transfer longitudinal motion of the speaker coil to the flat plate to cause movement of the flat plate. The system further includes a speaker mount which acoustically and mechanically couples the flat plate to the movable member (e.g. the shop window) to efficiently transfer plate movements to the movable member to cause the movable member to directly radiate sound as a result of speaker coil motion.

In the microphone embodiments, rather than a speaker there is a sound transducer which includes a transducer element with a longitudinally-movable transducer active member (e.g. coil). There is also included the flat plate and rigid mechanical member connecting the transducer active member to the flat plate. There is a sound transducer mount which has the same function as the speaker mount. This arrangement allows sound to be transmitted through a movable member such as a window or conference room table top so that these movements can be transduced into sound.

The rigid mechanical member is preferably a beam. The beam may be accomplished with a wooden sound post. The beam should be fixed to the speaker coil at one end, and fixed to the flat plate at the other end. An adhesive such as epoxy can be used to fix the beam at both ends. For use on windows, the flat plate may be glass, which preferably has a thickness from approximately 3 millimeters to approximately 10 millimeters.

The speaker mount should force the flat plate against the movable member. This may be accomplished in one embodiment with a cantilever support stand coupled at its distal end to the speaker, with the other end adapted to rest on a floor.

It has been found that the cantilever is best attached to the speaker below the speaker center line so that the flat plate tends to self-adjust to have excellent contact with the window, so that sound is efficiently transferred in either direction through the window.

Alternatively, the mounting may be accomplished with one or more flexible lines which span the loudspeaker and are attached to fixed structures spaced from the loudspeaker to apply force to the speaker to press the flat plate against the movable member.

The speaker may include a housing containing the loudspeaker and to which the loudspeaker is mounted. There may also be included sound-absorbing material in the housing to inhibit sound radiation from the loudspeaker other than from the movable member.

The flat plate may be attached along its edges to this housing with a means that provides some compliance, to avoid a peak in audio response at wavelengths which are about the size of the plate. This compliance may be achieved with tapes such as acrylic tape which is about 25 millimeters wide to adhere the glass plate to the speaker box. This distributes the bond between the glass plate and the speaker box over a large area, which distributes the glass plate pivot point, and thus provides a degree of damping at the appropriate wavelength. The flat plate should be made of a material having acoustic impedance about the same as the acoustic impedance of the movable member against which it is pressed, to efficiently transfer movement of the flat plate to the movable member.

The glass plate transfers sound to the glass window through two modes of operation—bending and pumping. In the bending mode, the edge of the glass plate is constrained, and the post pushes on the center of the glass plate, thus bending the glass. If the edge of the glass plate is strongly constrained, the plate of glass has very strong resonance in the vertical and horizontal dimensions. The result of this would be to distort sound and make it of poor quality. It has been found that using a slightly compliant mounting, and making sure that the speaker plate is damped, reduces this resonance to an acceptable level. The compliant mounting may be accomplished by using acrylic tape to bond the glass plate to the speaker enclosure box. The speaker plate may be damped by placing a damping material, such as a tar-based sheet, directly on the plate.

In the pumping mode, the glass plate moves backwards and forwards as a whole. The compliance of the mounting allows for this mode of movement, and dramatically improves the base frequency response. It has further been found that mounting the speaker to the speaker plate with rubber grommets around the screws provides a similar form of compliance. In this case, the screws can be loosened or tightened to adjust the frequency response of the speaker.

In alternative embodiments, the soundpost could be mounted directly to the window or other sound-radiating member such as a conference table top, provided there was still a speaker plate to which the speaker was mounted. As the adhesives required are permanent, the arrangement would not be removable as is the case with the preferred embodiment in which glass-to-glass adhesion is relied upon.

Figure 2:
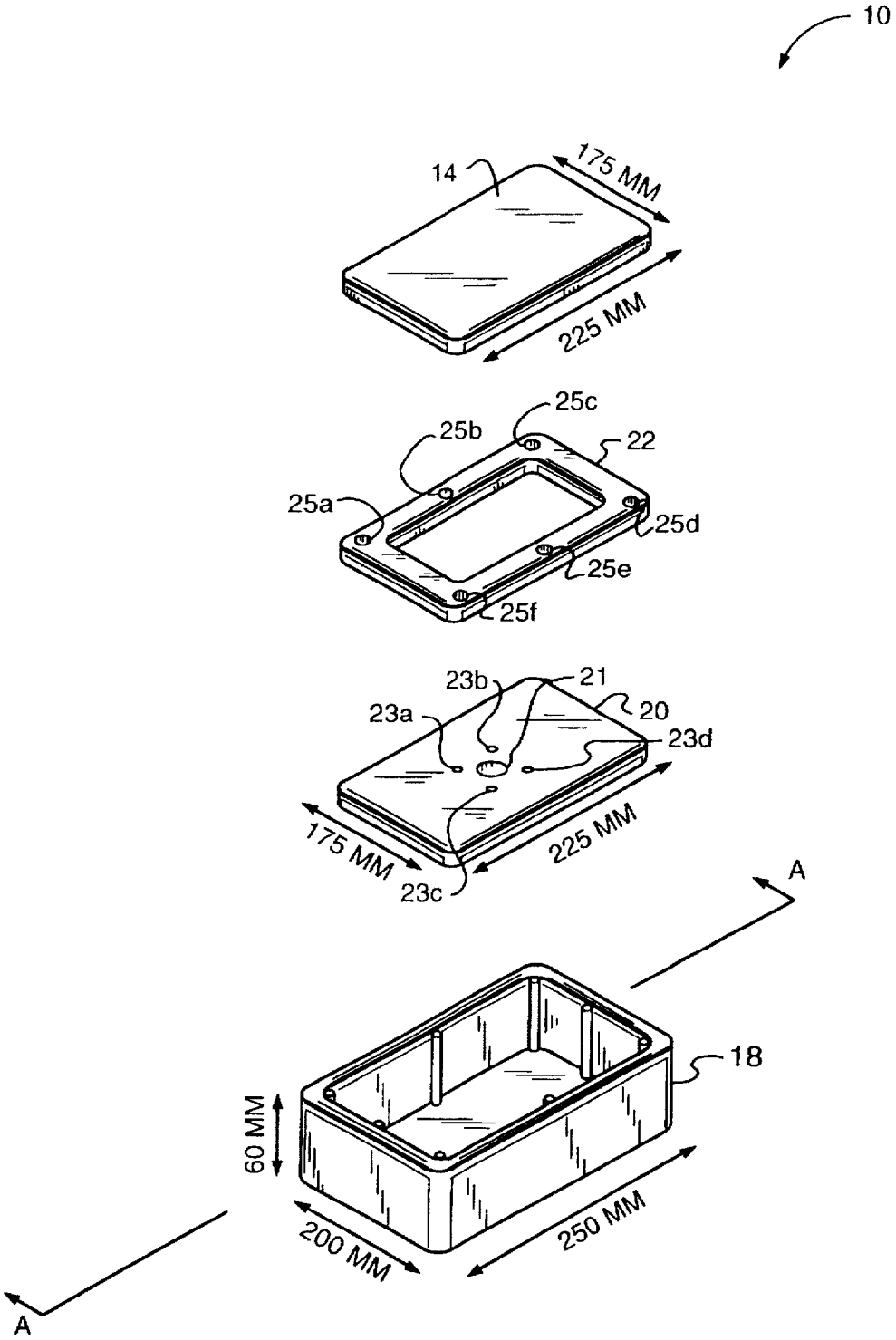
FIG. 2 is a more detailed exploded view of a portion of the assembly of FIG. 1.
Figure 3:
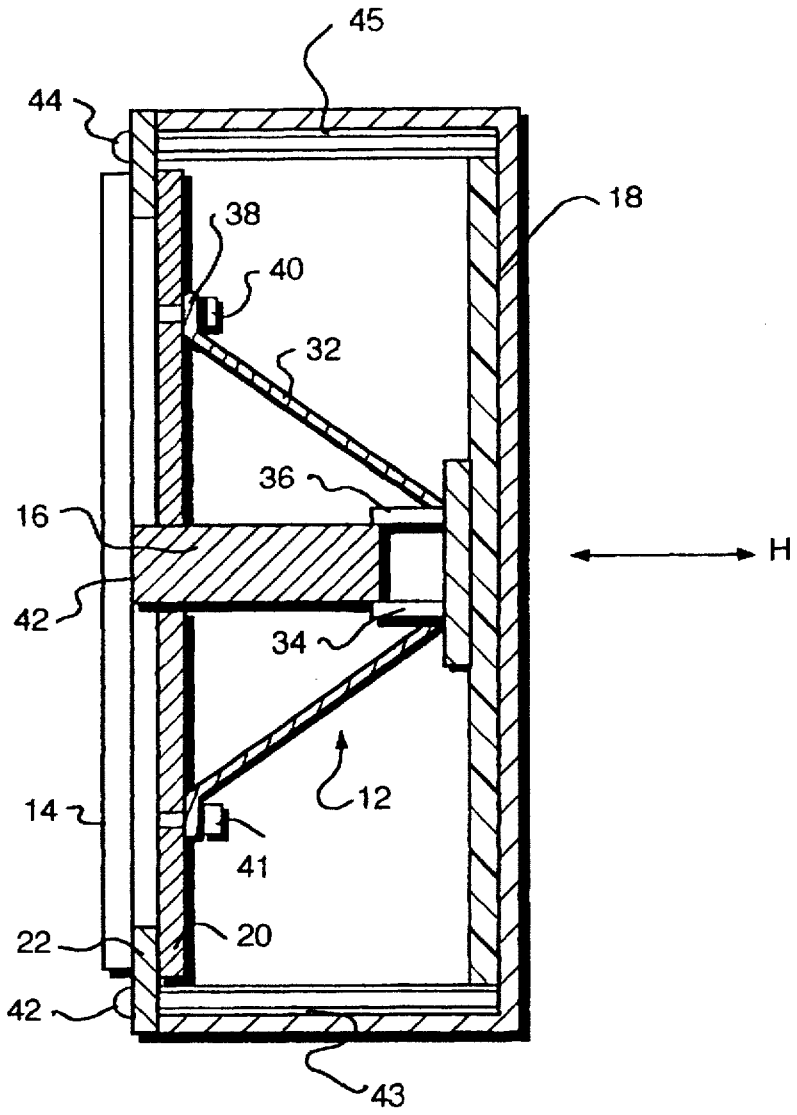
FIG. 3 is a cross sectional view taken along line A—A of FIG. 2 of the fully assembled system of FIG. 1.

There is shown in FIGS. 1 through 3 sound-radiating system 10 according to this invention for radiating sound through a movable member such as a glass window or a conference table top. Dimensions in millimeters are provided in FIG. 2. System 10 includes speaker 12 which is fixed to speaker plate 20. Plate 20 has hole 21 therethrough which allows sound post 16 to pass therethrough. Speaker 12 is received within box 18 and is surrounded by sound-absorbing material 24. Foam pad 26 may also be placed in the bottom of box 18. Together, material 24 and pad 26 help to absorb sound to inhibit radiation of sound into the room in which system 10 is found.

Cover 22 for box 18 has the same dimensions as box 18, and a central cut out with dimensions of about 160 by 210 millimeters. Glass plate 14 is placed on top of cover 22. As best shown in FIG. 3, wooden sound post 16 is connected between speaker coil 34 and glass plate 14. Epoxy 42 may be used to adhere one end of post 16 to glass plate 14. The other end is turned down to fit exactly within the opening in speaker coil 34, and may be fixed to the speaker coil by means such as epoxy resin.

The speaker cone of loudspeaker 12 is cut away to leave only speaker frame 32 which is fixed to speaker plate 20 by screws such as screws 40 and 41 that pass through tapped holes 23*a* through 23*d*, plate 20, FIG. 2. Screws such as screws 42 and 44 which pass through holes 25*a* through 25*f* in box lid 22 are used to hold lid 22 in place on box 18. Speaker plate 20 is held to lid 22 by the use of adhesive tape, which also provides some compliance, as described above, to increase sound quality.

Loudspeaker 12 is a standard loudspeaker with the exception of the fact that the speaker cone is cut away. Coil 34 is energized to move magnet 36 longitudinally back and forth in the direction of arrow H. For convenience herein, the moving portion of the magnet/coil combination is termed herein the "speaker coil". Rigid sound post 16 transfers longitudinal motion of magnet 36 to flat glass plate 14 to cause movement of plate 14. These movements of plate 14 are transferred to a movable member such as a glass window or conference room table top to cause the moveable member to directly radiate sound. The invention includes a speaker mount for both acoustically and mechanically coupling the flat plate 14 to the movable member so that the plate movements are efficiently transferred to the movable member to cause the movable member to directly radiate sound as a result of speaker magnet motion.

Two means of mounting the speaker in this manner are disclosed herein. It is the aim of the speaker mounts to press flat plate 14 against a shop or kiosk window, in order to achieve as much contact as possible between the flat plate and the movable member. Placing a vibrating glass plate against the glass of the window in this manner couples the sound efficiently to the window using the inherent glass-to-glass adhesion of two clean glass surfaces. The acoustic impedance of the flat plate and the movable member are the same or about the same to efficiently transfer sound therethrough.

Figure 4:
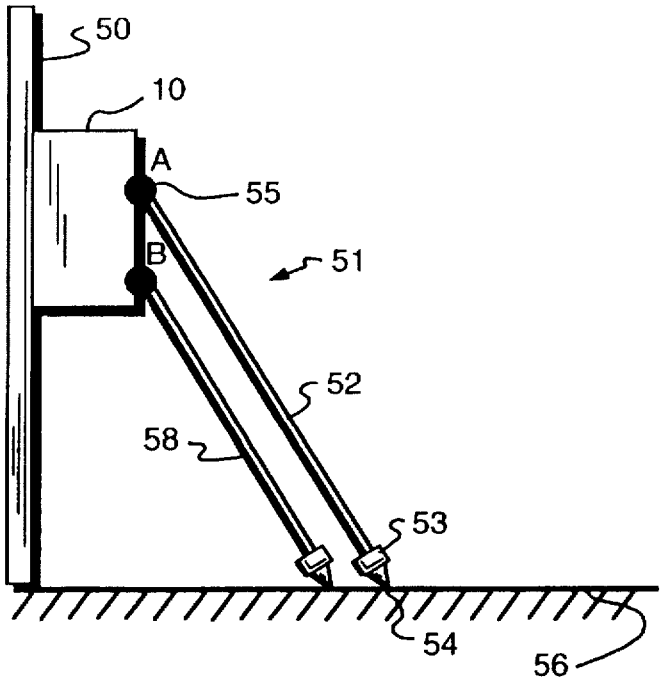
FIG. 4 is a side view of a through-glass speaker and/or microphone of this invention mounted to a shop window.

One means of mounting the speaker to a window is shown in FIG. 4. Support stand 51 for speaker 10 includes cantilever 52 which is attached at one end 55 to speaker 10, and at the other end includes cross member 53 having sharp point 54 which can be dug into carpeted floor 56. For use on a hard floor, a small block may be placed directly behind point 54 and attached to floor 56. The point of attachment A is preferably accomplished with one or more hinges such as hinge 30, FIG. 1. This allows speaker 10 to settle by its own weight so that good glass-to-glass adhesion between the flat plate and the window is accomplished.

It has been found experimentally that the optimum position for the hinge which connects member 52 to speaker 10 is at point B, which is approximately one-third of the height of the back of speaker 10 from its bottom. A lower position might allow the speaker to topple backwards on the hinge.

A higher position tends to press the upper portion of speaker 10 against window 50 and allow the bottom portion of speaker 10 to pivot a bit away from window 50 so that there is inefficient coupling of sound through the window. Thus, support 58 is the preferred position.

Figure 5A:
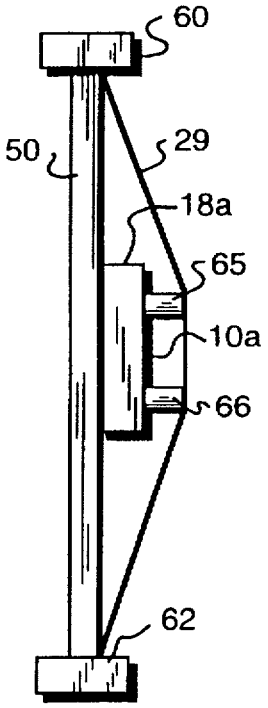
FIGS. 5A and 5B are side and rear views, respectively, of an alternative manner of mounting the through-glass speaker and/or microphone of this invention to a shop window.
Figure 5B:
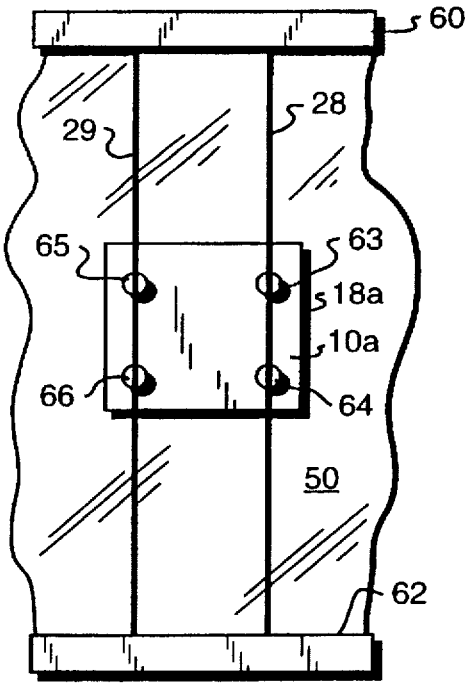

An alternative speaker mount shown in FIGS. 5A and 5B, and also in FIG. 1. Wires 28 and 29 are attached to the building at area 60 above window 50 and area 62 below window 50. Wire 28 is coupled to box 18*a* by way of posts 63 and 64 through which wire 28 passes, and that are fixed to the back of box 18*a*. Similarly, posts 65 and 66 connect wire 29 to box 18*a*. The wires can have any convenient means of tensioning them to apply force to box 18*a* to press the flat glass plate against window 50.

Figure 6:
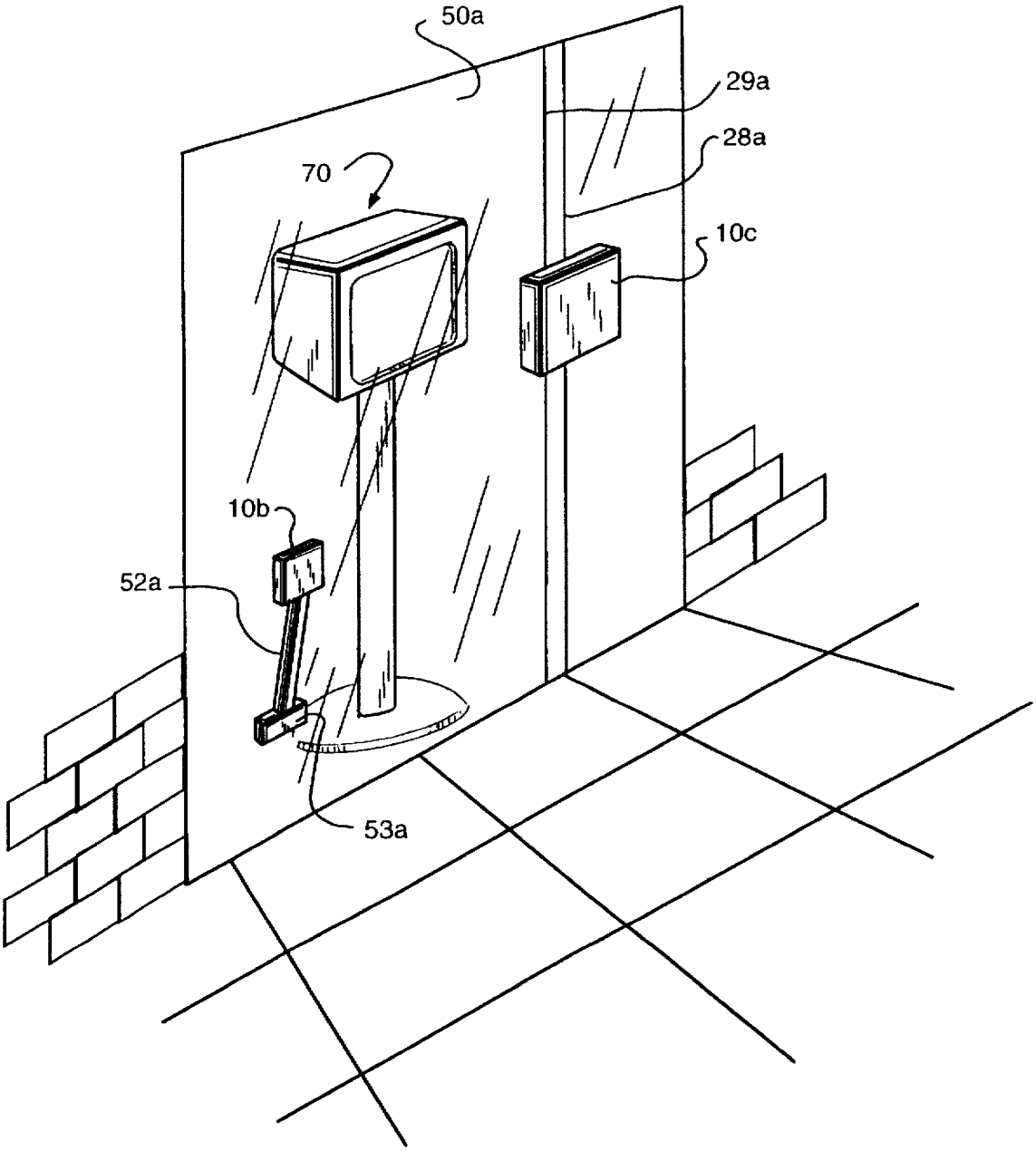
FIG. 6 is a simplified view of a multimedia information system in use inside of a shop employing two different arrangements of the through-glass speaker and/or microphone of this invention.

FIG. 6 is a simplified drawing of a multimedia system including the system of this invention in use. Speaker 10*b* is held against window 50*a* by cantilever 52 with lower support 53*a*. Microphone 10*c* is held against window 50*a* by wire supports 28*a* and 29*a*. Computer monitor 70 may also be mounted just inside of the window to provide a visual display to a person standing outside of shop window 50*a*.

Figure 7:
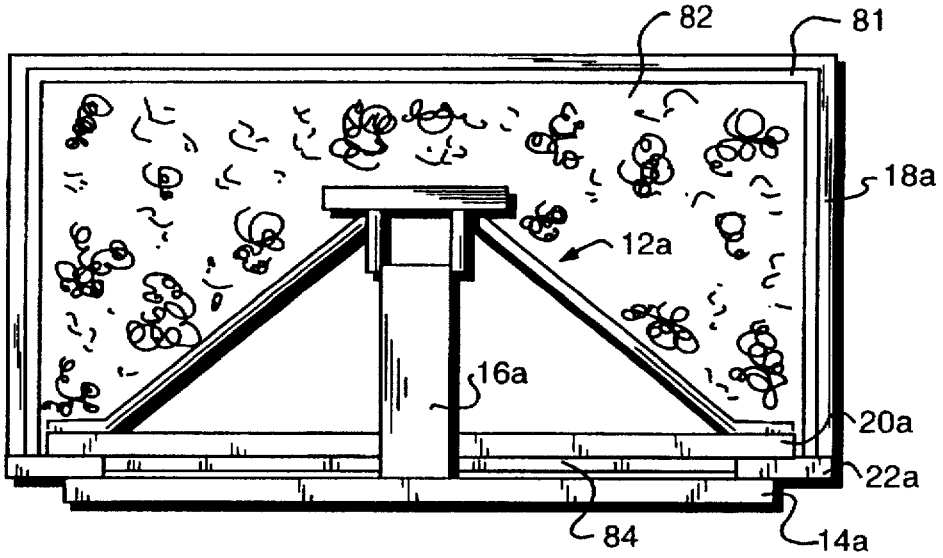
FIG. 7 is a cross-sectional view similar to that of FIG. 2 but detailing the sound damping.

FIG. 7 details the preferred embodiment of the damping within the speaker, which improves the quality of the sound output and reduces the amount of sound which propagates back into the space inside of the shop or kiosk. Speaker enclosure box 18*a* is coated on the inside with a foam sound absorbing material 81. Sound absorbing wool 82 is then used to fill the remaining space behind speaker 12*a* within enclosure 18*a*. The front of speaker plate 20*a* between the plate and glass sheet 14*a* has placed thereon a tar-based damping sheet 84. This reduces resonance in the material of the speaker, and absorbs sound that is not present on glass plate 14*a*.

Figure 8:
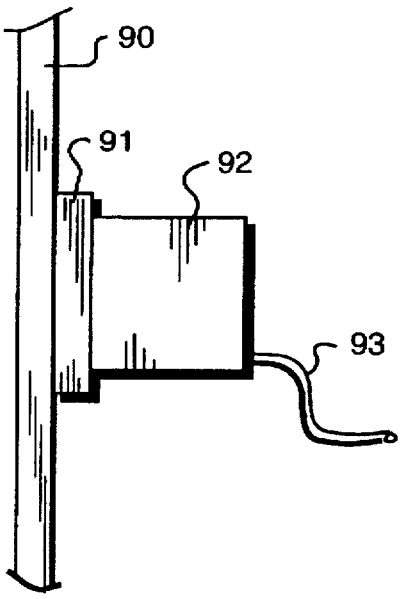
FIG. 8 is a simplified side view of a through-glass microphone according to this invention.

An embodiment of a through-window microphone according to this invention is shown in FIG. 8. A standard microphone, which is preferably an electret microphone 92 is adhered around its edges to a plate of glass 91, which is then placed against window 90 as described above for the speaker. Sound impinging on window 90 from the outside causes the window to move back and forth, causing the body of microphone 92 to move back and forth. The sensing element within microphone 92 tends to remain stationary due to its inertia, thus differential movement is introduced in microphone 92 by movement of window 90 and thus glass plate 91. Microphone 92 translates this differential movement into an electrical signal which is provided over cable 93 in a standard fashion.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A system for radiating sound from a movable member, comprising:

a speaker system including:

a loudspeaker with a longitudinally movable speaker coil;

a flat glass plate spaced from said speaker coil; and a rigid mechanical member connected between said speaker coil and said flat glass plate to transfer longitudinal motion of said speaker coil to said flat plate, to cause movement of said flat plate; and a speaker mount for acoustically and mechanically coupling said flat plate to a movable member to efficiently transfer plate movements to the movable member for causing the movable member to directly radiate sound as a result of speaker coil motion.

2. The sound radiating system of claim 1 in which said rigid mechanical member includes a beam.

3. The sound radiating system of claim 2 in which said beam is fixed to said speaker coil.

4. The sound radiating system of claim 2 in which said beam is fixed to said flat plate.

5. The sound radiating system of claim 4 in which said beam is fixed to said flat plate by an adhesive.

6. The sound radiating system of claim 5 in which said glass plate has a thickness of from approximately 3 millimeters to approximately 10 millimeters.

7. The sound radiating system of claim 1 in which said speaker mount includes means for forcing said flat plate against the movable member.

8. The sound radiating system of claim 7 in which said means for forcing said flat plate against the movable member includes a cantilever support stand coupled at its distal end to said speaker system, with the other end adapted to rest on a floor.

9. The sound radiating system of claim 8 in which said cantilever distal end is attached to said speaker system below the speaker system centerline.

10. The sound radiating system of claim 7 in which said means for forcing said flat plate against the movable member includes at least one flexible line spanning said loudspeaker and attached to fixed structures spaced from said loudspeaker, for applying force to said speaker system to press said flat plate against the movable member.

11. The sound radiating system of claim 1 in which said speaker system further includes a housing containing said loudspeaker and to which said loudspeaker is mounted.

12. The sound radiating system of claim 1 in which said speaker system further includes sound-absorbing material in said housing to inhibit sound radiation from said loudspeaker other than from said movable member.

* * * * *